United States Patent [19]

Tsukamoto

[11] 4,091,827

[45] May 30, 1978

[54] EDULCORATION EQUIPMENT FOR WIRE COILS

[76] Inventor: Kotaro Tsukamoto, 7-8, Kashima 4-Block, Yodogawa ward, Osaka City, Osaka Prefecture, Japan

[21] Appl. No.: 714,963

[22] Filed: Aug. 16, 1976

[51] Int. Cl.[2] ..... B08B 3/02; B08B 11/02

[52] U.S. Cl. ..... 134/149; 134/14; 134/152; 134/153; 118/DIG. 19; 118/304; 118/416; 118/425

[58] Field of Search ..... 134/14, 137, 144, 149, 134/152–153, 184, 199, 165; 118/DIG. 19, 304, 416, 425

[56] References Cited

U.S. PATENT DOCUMENTS

| | | | |
|---|---|---|---|
| 1,839,762 | 1/1932 | Johnston | 134/153 X |
| 2,158,687 | 5/1939 | Biggert, Jr. et al. | 134/14 |
| 2,225,501 | 12/1940 | Lapham et al. | 134/149 X |
| 3,348,394 | 10/1967 | Giros | 134/133 X |
| 3,649,326 | 3/1972 | Cole et al. | 118/416 X |

FOREIGN PATENT DOCUMENTS

| | | | |
|---|---|---|---|
| 2,013,412 | 7/1968 | France | 118/416 |
| 1,593,327 | 11/1968 | France | 134/14 |
| 835,822 | 2/1952 | Germany | 134/153 |

*Primary Examiner*—Robert L. Bleutge
*Attorney, Agent, or Firm*—Wenderoth, Lind & Ponack

[57] ABSTRACT

An apparatus for edulcorating a wire coil with an edulcoration fluid is provided which has a movable cart with an upright support and a plurality of horizontal, rotatable flanged shafts for supporting and rotating the wire coil, these shafts being mounted on the upright. A hollow pipe with outlets is positioned beneath the rotatable shafts on the upright to provide edulcoration fluid against the inside of a coil on the shafts, and a plurality of hollow pipes with outlets, also connected to the upright, are positioned above the rotatable shafts for providing edulcoration fluid against the outside of the coil on the shafts. The flanges on each of the shafts are at an angle to the axis of the respective shaft and are positioned in a special spaced relationship with regard to the flanges on the adjacent rotatable shaft.

5 Claims, 3 Drawing Figures

EDULCORATION EQUIPMENT FOR WIRE COILS

The present invention pertains to an edulcoration equipment with which acid sticking to pickled wire coils can be removed efficiently and completely.

BACKGROUND AND SUMMARY OF THE INVENTION

The usual method of washing away acid from pickled wire coils is to dip the coils into a water tank and repeat the dipping motions a number of times to remove acid from the surface of coils. This method is quite primitive, and moreover according to this conventional method, once the acid is removed, the acid dilutes the water and the diluted liquid sticks again to the coil surface. Therefore, to make sure of complete removal of all the acid, the water must be replaced frequently. Also, in the coiled condition, the material of the wire is coiled against itself and inhibits the acid substance thereon from being easily removed merely by up-and-down movements of the coil in the water tank. Thus, for thorough edulcoration of coils many hours are required, and this is highly inefficient, uneconomical and furthermore, the attending laborers must keep constant watch over the process.

The primary object of the present invention is to offer an edulcoration apparatus for wire coils which will overcome the shortcomings of the conventional, primitive method and assure efficient and perfect performance of edulcoration.

The second object of the present invention is to offer an edulcoration equipment capable of completely washing away acidsticking to the parts where wires in a coiled condition are in contact with each other.

BRIEF DESCRIPTION OF THE DRAWINGS

These and further objects will be clarified by the attached illustration, in which.

DETAILED DESCRIPTION OF THE INVENTION

Figure 1:
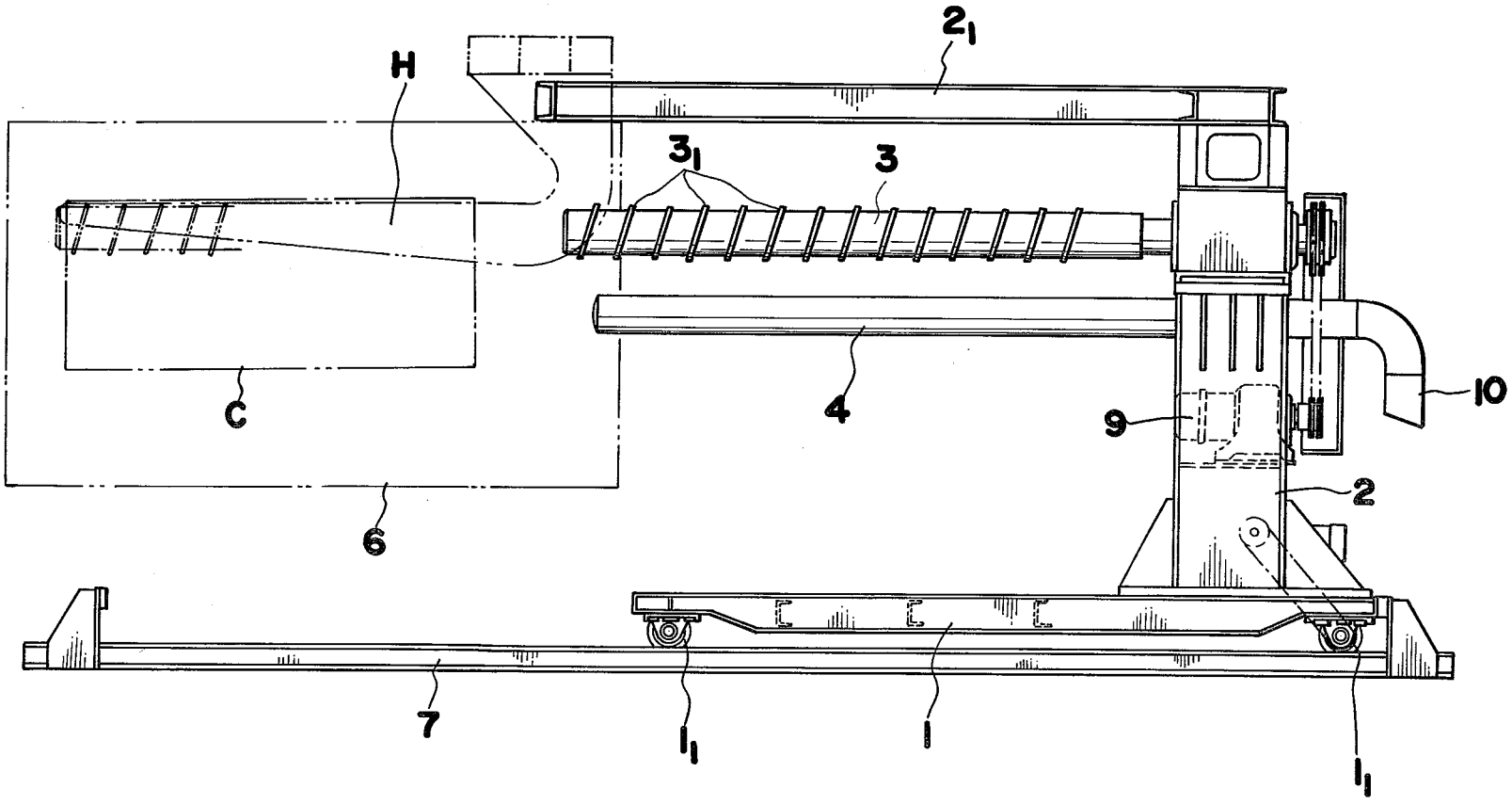
FIG. 1 is a front view of the edulcoration equipment for wire coils of the present invention.
Figure 2:
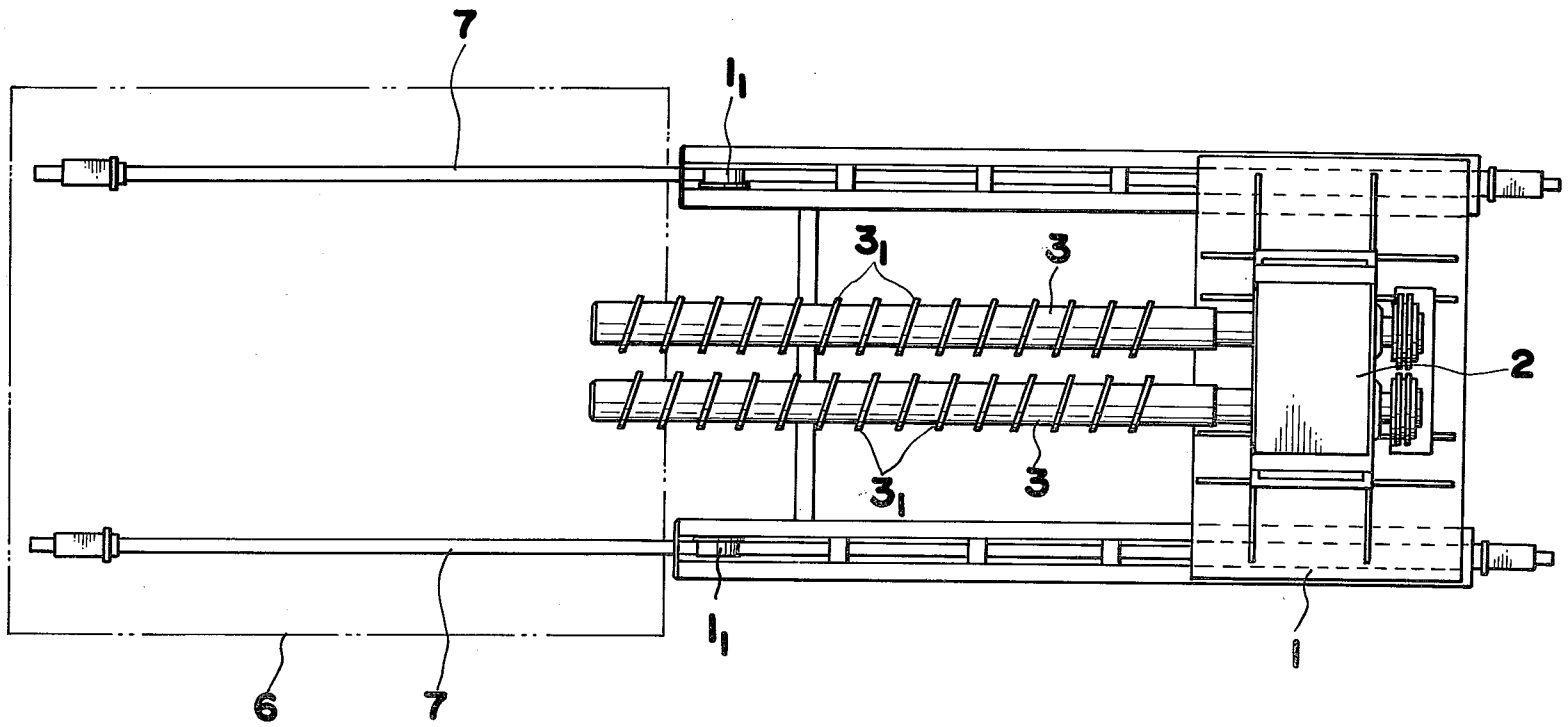
FIG. 2 is a plan view of the FIG. 1.
Figure 3:
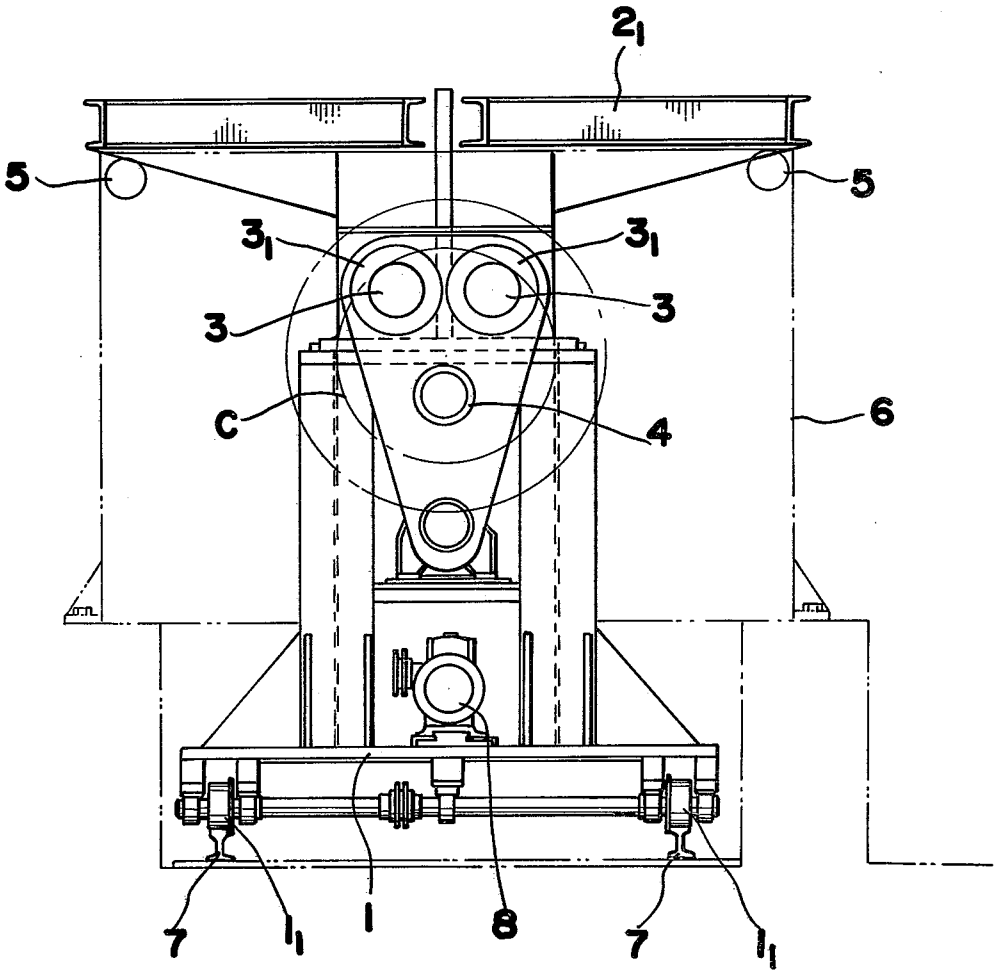
FIG. 3 is a lateral view of the FIG. 1.

The equipment of the present invention in FIG. 1 shows a cart 1 on the wheels 1, which runs over rails 7. This cart 1 has a column 2 supported on it. Two rotary shafts 3, 3 have multiple flanges $3_1$ therearound which are arranged to slant in a direction at right angles to the center of each shaft. The flanges $3_1$, on their respective rotary shafts 3, are horizontally positioned parallel to each other in such a way as to slip from each other by half a pitch respectively. An ejection pipe 4 of about the same length as the rotary shafts is capable of ejecting the edulcoration liquid outward. This pipe 4 is horizontally fixed a little below the rotary shafts. Ejection pipes 5, 5 eject edulcoration liquid into the turning direction of the rotary shafts and are set below covers $2_1$, $2_1$ at the uppermost end of the column. A water tank 6 is provided to prevent the edulcoration liquid from splashing during the course of the edulcoration work. While the edulcoration is in progress and the cart 1 in operation, the rotary shafts 3, 3, as well as the ejection pipe 4, can be inserted into the tank through the ports in the side of the tank. The motor 8 drives the wheels 1, and 1, and another motor 9 moves the rotary shafts 3, 3. A connecting pipe 10 supplies edulcoration liquid to the ejection pipes 4 and 5 and is operated by a pump which is not illustrated.

By operating a hanger H, the edulcorated coil C, as illustrated in FIG. 1, is shifted to the rotary shafts 3 and 3 is hung therein such a way as to hold the ejection pipe 4 thereinside. Then, the motor 8 is started to move the cart 1 to the left, and the wire coil C on the rotary shafts 3, 3, assumes a position horizontally within the water tank 6.

The motor 9 then rotates the rotary shafts 3, 3 and at the same time, the pump which supplies the edulcoration liquid to the ejection pipes 4 and 5 pumps the edulcoration fluid. The high pressure liquid is ejected into the interior of the wire coil from the ejection pipe 4 and against the exterior of the coil from the ejection pipe 5. Because the shafts 3, 3 rotate along with the flanges $3_1$, the wire coil also turns round by itself, and at this time because of the interactions between the flanges $3_1$, slid by half a pitch on their respective rotary shafts 3, 3, the wire coil is expanded to the right and left in resistance to their strength of stability. Therefore, acid sticking to the interior and exterior, as well as to the surface of wire, is washed away and the water, containing this washed acid, is temporarily deposited at the bottom of water tank to be later discharged through an exhaust pipe or drain.

On completion of the edulcoration process, the equipment is returned to its condition illustrated in FIG. 1 by reversing the process, and for each coil thereafter, the above mentioned process is repeated.

According to the edulcoration apparatus of the present invention, the wire coil is arranged to rotate by itself as explicitly described relative the structure and performance, and while it is expanded in resistance to the strength of stability the high pressure liquid is ejected into the interior and against the exterior of the coil. In this way, the acid is completely washed away from the wire surface, thus assuring efficient edulcoration in an extremely shortened time in comparison to the primitive method conventionally practiced. Finally, it is also possible for the injection pipes 5 and 5, to be stationarily installed inside the water tank 6. The apparatus will still perform the same.

What is claimed is:

1. An apparatus for edulcorating a wire coil with an edulcoration fluid said apparatus comprising:

a movable cart;

an upright projecting upward from said cart;

a plurality of horizontal rotating cylindrical shaft means for supporting and rotating said wire coil, said shaft means being horizontally parallel to and spaced from each other, mounted for rotation on said upright and projecting therefrom;

a plurality of parallel, angled flanges surrounding each of said shaft means at an angle with respect to the longitudinal axis of each of said shaft means, said flanges on each of said shaft means being positioned along said shaft means in positions which correspond to the midpoint between the flanges on the adjacent shaft means;

first edulcoration means beneath said rotary cylindrical shafts and mounted on said upright for supplying said edulcoration fluid against the inside of a wire coil supported on said shaft means, said first edulcoration means being comprised of: a pump means for pumping said edulcoration fluid and at least one, first hollow pipe connected to said pump means and mounted on said upright beneath and parallel to said shaft means with openings directed toward the inside of said wire coil on said shaft means; and second edulcoration means above said shaft means and outside of said wire coil on said shaft means and mounted on said upright for supplying edulcoration fluid against the outside of said wire coil on said shaft means, said second edulcoration means being comprised of a plurality of second hollow pipes connected to said upright and projecting outward therefrom parallel to said shaft means and spaced therefrom, said hollow pipes having openings directed toward said shaft means, and said second hollow pipes being further connected to said pump means, whereby edulcoration fluid may be pumped therethrough at the same time said fluid is pumped through said first hollow pipe and said fluid in said second pipes will flow through said openings therein toward said shaft means and said wire coil thereon.

2. An apparatus as claimed in claim 1, further comprising tank means spaced from said cart for receiving said wire coil on said shaft means and said second edulcoration means therein and for collecting said edulcoration fluid pumped against said wire coil through said first and second hollow tubes.

3. An apparatus as claimed in claim 1, further comprising at least one cover fitted to and projecting from said upright over said second edulcoration means.

4. An apparatus for edulcorating a wire coil with an edulcoration fluid, said apparatus comprising:

a movable cart;

an upright projecting upward from said cart;

a plurality of horizontal rotating cylindrical shaft means for supporting and rotating of said wire coil, said shaft means being horizontally parallel to and spaced from each other, mounted for rotation on said upright and projecting therefrom;

a plurality of parallel, angled flanges surrounding each of said shaft means at an angle with respect to the longitudinal axis of each of said shaft means, said flanges on each of said shaft means being positioned along said shaft means in positions which correspond to the midpoint between the flanges on the adjacent shaft means;

first edulcoration means beneath said rotary cylindrical shafts and mounted on said upright for supplying said edulcoration fluid against the inside of a wire coil supported on said shaft means, said first edulcoration means being comprised of: a pump means for pumping said edulcoration fluid and at least one first hollow pipe connected to said pump means and mounted on said upright beneath and parallel to said shaft means with openings directed toward the inside of said wire coil supported on said shaft means;

tank means spaced from said cart for receiving said rotating shaft means and said wire coil supported thereon thereinside and for collecting said edulcoration fluid; and second edulcoration means mounted on the inside of said tank means and directed toward the inside of said tank means for supplying said edulcoration fluid against the outside of said wire coil in said tank means.

5. An apparatus as claimed in claim 4, wherein said second edulcoration means is comprised of a pump means for pumping said edulcoration fluid and a plurality of second hollow pipes with openings directed toward the inside of said tank means, and connected to said pump means.

* * * * *